United States Patent [19]

Isobe

[11] 3,960,216

[45] June 1, 1976

[54] FIRE-EXTINGUSHING EQUIPMENT

[76] Inventor: Mineo Isobe, No. 1111, Sanyso-cho, Suzuka, Mie, Japan

[22] Filed: Jan. 28, 1975

[21] Appl. No.: 544,917

[30] Foreign Application Priority Data

| | | |
|---|---|---|
| Jan. 28, 1974 | Japan | 49-11653 |
| Mar. 4, 1974 | Japan | 49-25408 |
| May 21, 1974 | Japan | 49-57529 |
| Aug. 14, 1974 | Japan | 49-93599 |

[52] U.S. Cl. ..... 169/48; 160/1

[51] Int. Cl.[2] ..... E06B 5/16

[58] Field of Search ..... 169/45, 46, 48, 49, 169/54, 56, 43; 160/44, 1

[56] References Cited

UNITED STATES PATENTS

| | | | |
|---|---|---|---|
| 1,369,518 | 2/1921 | Bumbarger | 160/1 |
| 3,361,214 | 1/1968 | Elliott | 169/49 |
| 3,687,185 | 8/1972 | Singer | 160/1 |
| 3,877,525 | 4/1975 | Husson et al. | 169/48 |

*Primary Examiner*—John J. Love
*Assistant Examiner*—Michael Mar
*Attorney, Agent, or Firm*—Wenderoth, Lind & Ponack

[57] ABSTRACT

A fire-extinguishing apparatus for a use inside a building wherein a cloth curtain is used to shut off a burning area from a non-burning area, and wherein a support is provided for suspending and winding up the cloth curtain, and a water feeder supplies water continuously to the cloth curtain over the entire length of the width direction at the upper end so that the whole surface of the cloth curtain is covered by the water flowing thereon from the upper end to the lower end.

31 Claims, 7 Drawing Figures

FIRE-EXTINGUSHING EQUIPMENT

This invention relates to fire-extinguishing equipment.

In recent building fire accidents large numbers of people have been wounded or killed not by the fire itself, but rather by suffocation because of the presence of large amounts of noxious gases, consisting mainly of carbon monoxide, generated during the combustion of plastic products used as interior furnishing of buildings at the outbreak of the fire.

At the present time, various kinds of fire-extinguishing equipment have been contrived, but since they are mostly highly complicated and are constructed as a general combination of means having independent functions such as sprinklers which are the means for directly extinguishing fire, shutters which are the means for preventing the spread of fire and smoke, smoke exhausting means, etc., they normally require a lot of space and considerably expensive to install, and there is still considerable doubt as to whether they actually work at the time of a fire. This doubt is obviously manifested by the fact that even today many people are wounded or killed when a fire breaks out in a building.

An object of the present invention is to provide a fire-extinguishing apparatus which is capable not only of extinguishing a fire but which also prevents noxious gases and heat from spreading.

Another object of this invention is to provide a fire-extinguishing apparatus of a simple construction which guarantees steady operation at the time of fire.

A further object of the invention is to provide a fire-extinguishing apparatus which can be installed without largely modifying the construction of the existing building and without requiring a large space for installation.

A still further object of the invention is to provide a fire-extinguishing apparatus which permits, during the operation of said apparatus, people's refuge outside and observation of the condition of fire therethrough.

These and other objects of the invention will become apparent from the subsequent descriptions made in reference to the accompanying drawings, in which.

Figure 1:
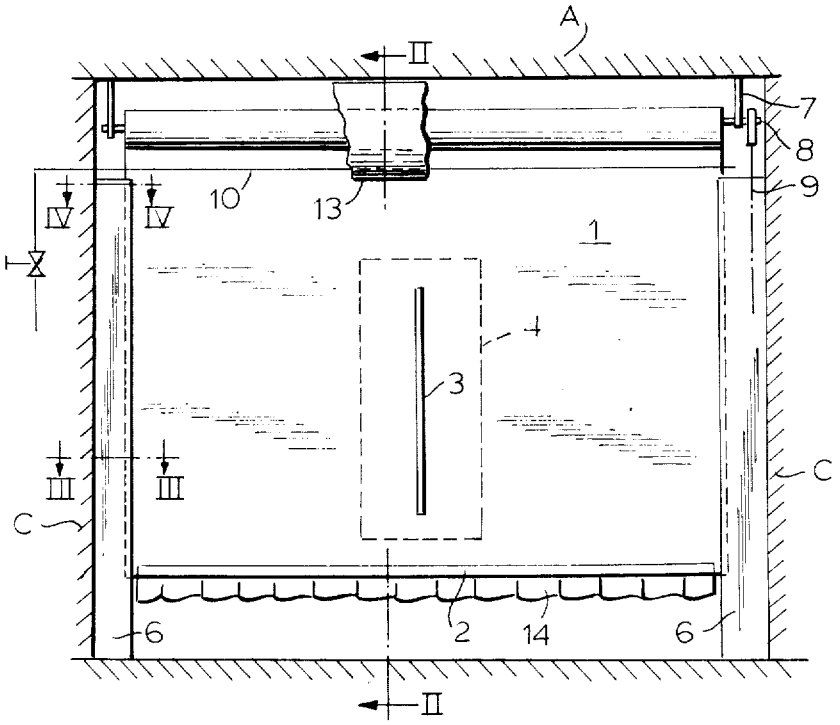
FIG. 1 is a schematic view showing partly in section the fire-extinguishing equipment as an embodiment of the invention provided between the pillars of a certain floor of a building.

Basically, the fire-extinguishing equipment of the present invention comprises a cloth and a means for wetting the whole surfaces thereof by feeding water to said cloth. The state of the water which thus keeps the whole surfaces of the cloth wet will be hereinafter expressed as a "continuous water coating" or "continuous water curtain".

For the cloth, a natural fiber cloth or a chemical fiber which is conventionally available on the market, preferably of flame-retardant or anti-combustible property can be used. The cloth should have an affinity for water or be wettable with water. In general, the cloth is preferred to be of thin texture, for instance, see-through to a certain extent.

Suitable fiber cloths available on the commercial market are a cloth of phenol-formaldehyde fiber (made by Nippon Kynol Incorporated); trade narm "KYNOL"; having 44% strength retentability when kept at 300°C for 5 minutes), a cloth of aromatic polyamide fiber (made by Teijin, Ltd.; trade name "CONEX", having a decomposition point of 400° to 430°C), a cloth of polytetrafluoroethylene fiber (made by Toray Industries Inc.; trade name "TOYOFLON"; resistive to a temperature of 315°C for 1 minute), a cloth of polyamide cellulosic fiber (made by Mitsubishi Rayon Co., Ltd.; trade name "PERNEL"), etc. The cloth may also be any ordinary cloth subjected to flame-retardant or anti-combustible treatment by a conventional procedure.

Experiments were conducted by the present inventor using "KYNOL" cloth (plain weave fabric consisting of 70 pieces of warp and 47 pieces of weft per square inch with the interstice of weave pattern being taken at an interval in which nearly same number of warps and wefts as above can be woven in additionally). Said cloth was perpendicularly hung, and from the top of said cloth water was fed at the rate of 4 lit./min. per 1m. of cloth width. With the cloth kept in the above state, the flame of an acetylene burner was brought into contact at right angles to the cloth (the temperature of flame at the position of contact was about 3,000°C). In the above experiment, said cloth was observed to have sustained no damage at all even after a lapse of about 50 seconds or longer, thereby showing that the apparatus of the present invention exhibits a sufficient resistivity to fire. Thus, it is a surprising discovery to learn that the conventionally marketed flame-retardant or anti-combustible cloth sustains no damage at all in spite of its exposure to a flame of high temperature such as 3000°C, from which it is well understood that in the present invention the intended object can be satisfactorily achieved without using the substantially incombustible cloth. It was also noticed that, by measuring the temperature with a thermometer at its temperature-sensitive portion placed in contact with the reverse side of the portion of the cloth to which the flame was contacted, only a slight change of temperature was noticed, and after touching the temperature-sensitive portion by hand, the hand was entirely free from any danger of sustaining a burn. This further supports the outstanding effect of fire heat sealing displayed by the equipment of the present invention. Further, when soot produced at the time of non-combustion of acetylene burner reaches the cloth, a spread of such soot is prevented by water and the soot drops with water. From this it can be concluded that the equipment of the present invention is effective in preventing smoke and noxious gases from spreading. For the sake of comparison, a similar experiment was effected with the use of a steel plate 2.3mm thick without applying water; a penetrating hole was formed through said steel plate after lapse of about 50 seconds.

Basically, the object of the present invention can be attained by the combination between cloth and water as above. As understood from the above experiment, the amount of water fed to the cloth may be of a degree to form at least a continuous water coating on the cloth.

The cloth 1 and the water feed 1 are illustrated in FIG. 1.

Figure 2:
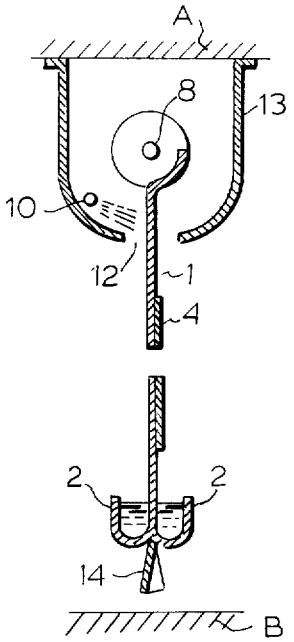
FIG. 2 is an enlarged sectional view of the part taken in accordance with II — II line of FIG. 1.

In FIG. 1, the cloth 1 has a length which can reach at least from the ceiling A to the floor B and also has a width corresponding to at least the distance between the pillars C (or walls). At the lower end of the cloth 1, there is provided a water-retaining means (i.e. a reservoir) 2. Said reservoir 2 is constituted by sewing to said cloth 1 another cloth consisting of material the same as, or similar to the cloth 1, when desired, which has received waterproofing treatment. The reservoir 2 is provided either on either one or both surfaces of the cloth 1 over nearly its entire width as shown in FIG. 2, and its internal portions are divided into a plurality of pockets by a plurality of partitions. In the center of the lower half of the cloth 1 is a vertical slit 3, and sewed to the cloth 1 is a covering cloth 4 consisting of the same material or material similar to the cloth 1, said covering cloth 4 being sewn at its upper end to said cloth 1 and covering said slit 3. The slit 3 and the covering cloth 4 provide an opening so that people can move between sections of rooms through the present apparatus at the outbreak of a fire, and also provide a covering for the opening. It may also be advisable to provide, together with the slit 3 and covering cloth 4 or even without them, at the lower end portion of the reservoir 2, a many pleated skirt 14 of the same material as or similar to the cloth 1.

Figure 3:
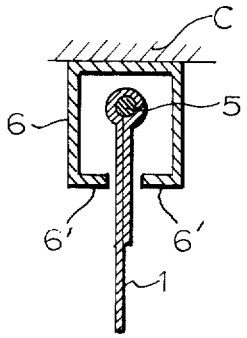
FIG. 3 is an enlarged sectional view of the part taken in accordance with III — III line of FIG. 1.

At each side of the cloth 1, a rope 5 may be fitted to the whole length of the cloth 1, said rope being supported as movable only in upward and downward directions by the guides 6 which are provided on both sides of the pillars C. As shown in FIG. 3, the guide 6 has bent pieces 6', 6' that form a groove in which the cloth 1 to be guided up and down, said guide 6 containing the cloth portions to which the rope 5 is fitted. This combination of rope and guide is provided to insure effective sealing of the section of the room on fire.

The upper end portion of the cloth 1 is fixed to a rotating shaft 8 of support bars 7 and is supported so that the cloth 1 may be wound up and released down. The support bars 7 are secured to the ceiling A, and are constructed so that they are capable of winding up or releasing the cloth 1 by using an ordinary manual or mechanical winder 9. In the simplest structure, the system is constructed in such a way that the said winder 9 for winding up the cloth 1 is hand-operated, but has a sufficient degree of resistance as to prevent the cloth from unwinding under its own weight.

At the position above the reservoir 2 on the cloth 1 which has been wound up by the above supports 7, a water feeder 10 is disposed. Said water feeder 10 is long enough to cover the whole width of the cloth 1. Water feeder 10 is an ordinary metal tube provided with a number of holes in the lengthwise direction.

As understood from the above experiments, a large volume of water need not be fed to the cloth 1 nor is high pressure required; it is sufficient for the water feeder 10 to be connected to an ordinary water supply source of service water or presently available fire-extinguishing equipment. The valve 11 connected to said water feeder 10 can be a manual type or an electromagnetic valve connected electrically to a fire detecting device of the type presently available.

A cover 13 secured to the ceiling A surrounds the support 7 and the water feeder 10 and has an opening 12 for winding up and releasing therethrough the cloth 1. Said cover 13 effectively seals and shuts-off the section on fire and protects the cloth 1 to which water is not sprayed and the support 7 from the heat of the fire.

According to the equipment of the present invention which comprises the above construction, when a fire occurs, water is sprayed onto the wound up cloth 1 from the water feeder 10, and simultaneously with the formation of the water coating over the cloth 1, the water pools in the reservoir 2, and the weight of the water in the reservoir causes the cloth 1 to fall down by itself. If necessary, the descent of the cloth may be hastened manually. The reservoir 2 satisfactorily pools water even if it may not be provided on the same side as the water feeder 10 against the cloth 1. Because of the weight of the water in the reservoir 2, the lower end of the cloth 1 reaches the floor B, thereby cutting off the section on fire. Also, even if the surface of the floor B is rough, the cloth 1 contacts the floor B in line with said rough levels. Even if pressure differences arise between the inside and the outside positions of the separated portions at the occurrence and the extinction of the fire respectively, the adoption of the above construction assures sufficient maintenance of the fire separating effect. The covering cloth 4 over the slit 3 comes into close contact with the cloth 1 because of the falling water. Though said covering cloth 4 may be held up manually (to pass therethrough), it will not detach from the cloth 1 because of the above pressure differences. Also, since the cloth 1 is in contact with the floor B only because of the weight of the water pooled in the reservoir 2, people may escape under the cloth 1 by holding up the edge of the lower end of the the cloth 1 manually. For this reason, preferably said cloth 1 has some allowance in its length for the provision of the skirt 14.

When ventilation from the outside is prevented by the equipment of the present invention, the fire is quickly extinguished as soon as the oxygen in the air has been consumed. During this interval, smoke and noxious gases produced are effectively prevented from spreading outside, and the heat is also shut off. Such a condition of fire extinction can readily be observed from the outside of the cloth if a thin textured cloth is used. Immediately after extinction of the fire, the burned portion contains smoldering embers but is not flared up. To these embers a direct pouring of water is desirable as in the case of the conventional fire extinguishing method. Also, the spray of water to the cloth 1 from the water feeder 10 should not be stopped before the noxious gases and smoke have sufficiently been extinguished into the atmosphere. The smoke and fumes may be satisfactorily extinguished in a short time by themselves without requiring any smoke exhausting device. When the water supply is discontinued or stopped earlier than necessary, the fire may flare up again and soot may adhere to the cloth 1, thereby preventing a formation of a satisfactory water coating on the cloth 1 any furthere.

Based on the equipment of the present invention comprising such a construction, the following experimental tests were carried out. In order to compose a space having the length, width, and height of 9m, 5.4m, and 3m, respectively, heat-resistive light weight concrete boards were built up. At the entrance thereto (having the height of 3m, and the width of 5m) a fire-extinguishing apparatus as shown in FIG. 1 was set up. (For the cloth, the above "KYNOL" cloth was used). On the other three wall surfaces, aluminum-framed windows of the type conventionally used for ordinary households were provided, and on the insides of these windows similar fire-extinguishing apparatuses (comprising the combination of cloth and water feeding facilities only, with the cloth provided in ordinary curtain style so as to be openable sideways) were set up. On almost all the floor surfaces of the above space, about 300 kgs. of wood was piled up, on which about 10 litres of kerosene oil was poured thereon and a fire was set. Twenty seconds after setting fire, water began spraying from the water feeder to the cloth of the fire-extinguishing apparatuses at the entrance and the window positions. At the entrance, the cloth was unwound and hanging about 30 sec. after the start of the water feeding. About 6 minutes after closing and sealing the internal space, it was observed from outside through said cloth that the flames were fading out, and during this time no spreading of smoke or gases outside was observed. Instantly thereafter, water was poured directly through the window to fully extinguish the fire. When the above fire-extinguishing apparatus was not installed, the window-pane immediately broke at the occurrence of the fire, but the same remained in tact when the fire-extinguishing apparatus was provided. This is indicative of the superior heat-shutting effect of the present invention. With regard to the cloth used for the apparatus of the present invention, no damage was noticed at all, and it was guaranteed to endure subsequent re-use.

As explained above, the present invention has superior points, but it does not satisfactorily cover the original purpose if the ceiling, floor, pillars, etc. in the room wherein the apparatus is installed are of the easily combustible construction. The present invention displays its real merit in buildings where the basic structure consists of the incombustible and heat-resistive materials. The present invention may be provided by utilizing the walls instead of the pillars in the room so that an adequate number of closed sections are formed in a single room with the apparatus of the present invention. Also, the apparatus should preferably be provided around staircase steps. Adoption of the above style of installation makes it possible to surround only the burning section to the minimum extent necessary, thereby preventing the spread of smoke, noxious gases, and fire to other places and minimizing personal and material damage. It is, of course, advisable to have the present invention set up coupled with the existing fire-extinguishing equipment.

Figure 4:
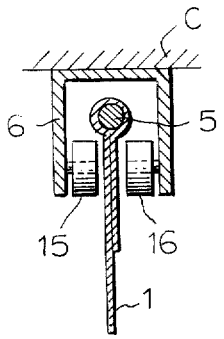
FIG. 4 is an enlarged sectional view of the part taken in accordance with IV — IV line of FIG. 1.
Figure 5:
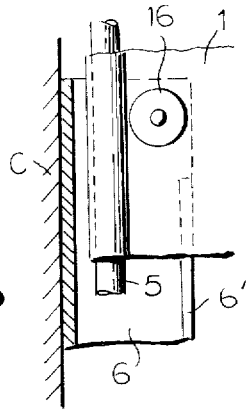
FIG. 5 is a vertical sectional view of the part (guide portion) shown in FIG. 4.

The constructions shown in FIG. 4 and FIG. 5 indicate improvements to the above guide 6 at its upper end opening portion. More particularly, said upper end portion has neither of the bent pieces 6', 6', but is provided with the rollers 15 and 16 on each side of the guide, with spaces formed between both rollers to permit the cloth 1 to pass freely therethrough. Other rollers (not shown) may be provided on the base portion of the guide 6 disposed oppositely to the rollers 15 and 16 so as to hold the part of the cloth 1 fitted with the rope 5. When the entire cloth 1 having the rope-like means 5 is wound onto the rotating shaft 8 of said supporting means 7, the lateral terminal portions of the cloth 1 may not be taken up uniformly due to the difference of the thickness between both terminal portions and the other area of the cloth 1. After releasing the cloth taken up in such irregular winding conditions, the induction of the terminal edge of the cloth 1 into the guide 6 is liable to become irregular, with variation of the take-up condition to the widthwise direction of the cloth, because of which the cloth 1 is apt to be caught by the upper opening end of the guide 6. However, if the construction described above is adopted, the descent of the cloth 1 to the guide 6 is smooth, guided by the rollers 15 and 16.

Figure 6:
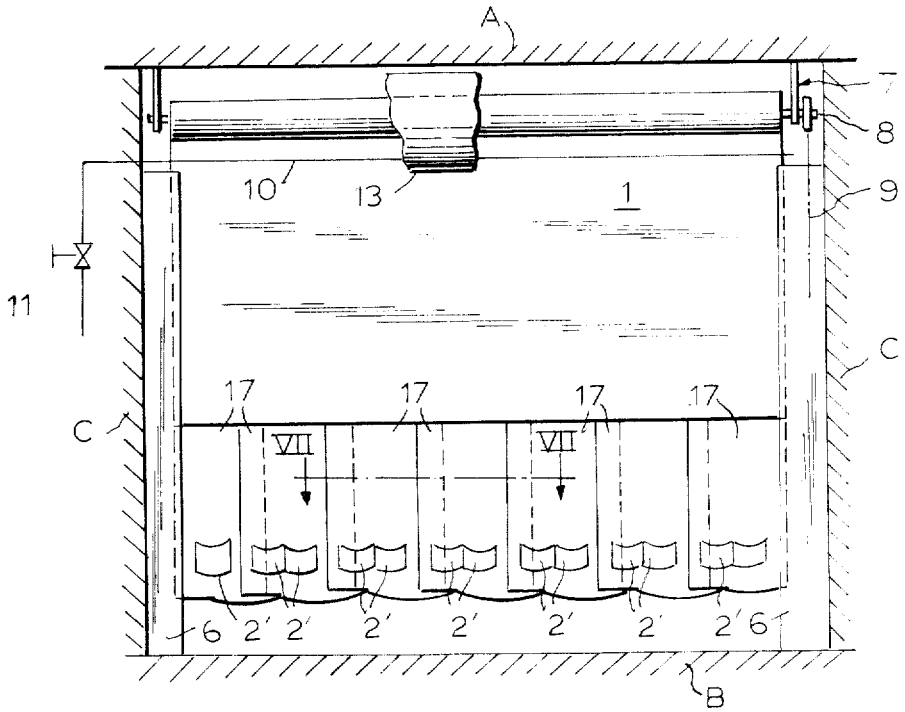
FIG. 6 is a schematic view which shows the fire-extinguishing equipment as another embodiment of the invention.
Figure 7:
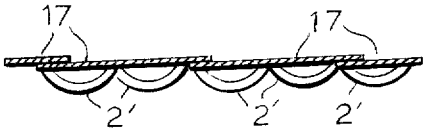
FIG. 7 is an enlarged sectional view of the part taken in accordance with VII — VII line of FIG. 6.

The constructions shown in FIG. 6 and FIG. 7 relate to the improvement to the lower half portions of the above cloth 1 to make it possible for people to exit therethrough more readily. More particularly, the lower half portion or the lower quarter portion of said cloth 1 has fixed thereto a plurality of thin strips 17 of the same material or materials similar to the cloth 1 with the edges of said strips mutually overlapping. To outermost edges of these cloth strips the ropes 5 are extended from the edges of cloth 1. When said cloth 1 is sufficiently unwound to bring the lower end of the strips 17 into sufficient contact with the floor B, said reservoir 2' is fitted to each of the strips 17 so that the apparatus is in contact with the floor B surface or in a position slightly spaced upward therefrom. Said reservoir 2' is formed on each of the strips 17 independently, preferably further divided into plurality of reservoirs (i.e., in pocket style). As shown in the drawings, the fitting and positioning of the reservoirs 2' is such that the reservoirs are arranged as if they were continued en bloc at a glance on one of the surfaces other than overlapped, excepting the overlapped portions of strips. On some of the strips, reservoirs 2' may be fitted to other surfaces. In short, the reservoirs 2' may be adequately fitted and positioned in consideration of the non-disturbance of the partial overlapping of the strips 17.

By constructing the lower half portion of the cloth 1 as above, people's refuge therethrough can be effected more readily and smoothly. There is no need for them to turn up the strips as in the case of the above cloth 4 or skirt 14, they simply bodily attack against the strips 17 and readily move from one side of the equipment to the other. Moreover, since the said apparatus allows utilization of the whole widthwise area, it affords a possibility for simultaneous refuge of a plurality of people. Also, since the reservoirs 2' are provided on each of the strips in the above fitting and positioning condition, the strip once moved for refuge returns to the original position by itself because of the weight of the water pooled at the bottom of the pockets of reservoirs and regains close contact with another strip by the action of water, thus returning to a state as if these strips were composed of a single sheet of cloth. Accordingly, the cloth 1 in this case need not be provided with any breadthwise allowance for holding up for refuge purpose, but may be supported in a tensioned state. This decrease of width of the cloth 1 is a matter connected with the provision of efficiency for formation of the continuous water coating. Also, the cloth 1 may be composed of a thick material or a combination with the substantially incombustible cloth such as asbestos cloth, thereby making it possible to incorporate a constitution to display its resistivity to heat to a sufficient degree.

What is claimed is:

1. A fire preventing and extinguishing apparatus for use inside buildings, said apparatus comprising:

roller-mounted curtain means for separating a burning area from a non-burning area;

support means attached to the upper portion of said curtain means for suspending and rolling up said curtain means;

water feed means adjacent the upper portion of said curtain means and said support means for continuously supplying water to the surface of said curtain means, whereby water flows from the upper portion of said curtain means downward over the entire surface thereof; and reservoir means along the bottom portion of said curtain means for receiving and containing therein the water flowing downward over the surface of said curtain means.

2. An apparatus as claimed in claim 1, wherein said reservoir means is comprised of the lower end of said curtain means folded upward.

3. An apparatus as claimed in claim 2, wherein the lower folded portion of said curtain means comprising said reservoir means is attached to the sides of said curtain means, whereby a bag is formed at the bottom of said curtain means.

4. An apparatus as claimed in claim 1, wherein said reservoir means is comprised of material attached to the lower end of said curtain means in a width-wise direction.

5. An apparatus as claimed in claim 4 wherein said material from which said reservoir means is made is similar to the material of said curtain means.

6. An apparatus as claimed in claim 1 wherein said curtain means is comprised of water-wettable cloth material.

7. An apparatus as claimed in claim 6 wherein said cloth material is flame retardant and non-combustible.

8. An apparatus as claimed in claim 6 wherein said cloth is of thin texture.

9. An apparatus as claimed in claim 1 wherein said curtain means is of sufficient length to extend from the ceiling to the floor of the room in which it is positioned.

10. An apparatus as claimed in claim 9 wherein said curtain means is of sufficient width to extend over the walls of the room or extend between the support pillars of the room in which it is positioned.

11. An apparatus as claimed in claim 10 wherein said curtain means is comprised of a plurality of cloth strips.

12. An apparatus as claimed in claim 1 wherein said curtain means is pleated.

13. An apparatus as claimed in claim 1 wherein said curtain means has a skirt at the lower portion thereof.

14. An apparatus as claimed in claim 13 wherein said skirt is pleated.

15. An apparatus as claimed in claim 1 wherein said curtain means has at least one slit therethrough in a lengthwise direction at the lower portion thereof.

16. An apparatus as claimed in claim 15 further comprising a cloth cover attached to said curtain means above said slit, whereby lifting said cover means away from said slit allows access therethrough, and whereby releasing said cloth cover causes said cover to fall downward over said slit.

17. An apparatus as claimed in claim 1 wherein said support means is attached to the ceiling.

18. An apparatus as claimed in claim 17 wherein said support means is further provided for unwinding said curtain means.

19. A fire extinguishing apparatus for use inside a building comprising:

a water-wettable, non-combustible, flame retardant cloth curtain of sufficient length and width to completely cover an entire wall or open space between support pillars in a room in said building from the ceiling to the floor;

a water reservoir at the lower portion of said cloth curtain;

support means secured to the ceiling and attached to the upper portion of said cloth curtain for supporting and winding up said cloth curtain; and water feed means adjacent said support means for continuously supplying water over the entire width of said cloth curtain, whereby the entire surface of said cloth curtain is covered by water flowing downward thereon from the upper portion to the lower portion.

20. An apparatus as claimed in claim 19 wherein said cloth curtain is of thin texture.

21. An apparatus as claimed in claim 19, wherein said cloth curtain has a pleated skirt at the lower end portion thereof.

22. An apparatus as claimed in claim 19, wherein said cloth curtain has at least one slit therethrough at the lower portion thereof; and further comprising a cloth cover sewn at one end above said slit through said cloth curtain.

23. An apparatus as claimed in claim 19 wherein said reservoir is comprised of cloth sewn to the lower portion of said cloth curtain across the entire width thereof.

24. An apparatus as claimed in claim 23 wherein said reservoir is partitioned into a plurality of segments.

25. A fire-extinguishing apparatus for use inside a building comprising:

a cloth curtain of sufficient length and width to completely cover a wall or an open space between support pillars in a room in said building from the ceiling to the floor, said curtain being comprised of an upper cloth portion and a plurality of overlapping cloth strips fitted at the lower end of said upper cloth portion, said upper cloth portion and said overlapping cloth strips being comprised of water-wettable, non-combustible, flame-retardant materials;

a water reservoir on the lower portion of said cloth curtain;

support means secured to the ceiling and attached to the upper portion of said cloth curtain for supporting and winding up said cloth curtain; and water feed means positioned adjacent said support means for continuously supplying water across the entire width of said cloth curtain, whereby the entire surface of said curtain is covered by water flowing downward thereon from the upper portion to the lower portion.

26. An apparatus as claimed in claim 25 wherein said upper cloth portion of said cloth curtain is comprised of thick textured cloth, and said overlapping cloth strips are comprised of thin textured cloth material.

27. An apparatus as claimed in claim 25 wherein said water reservoir is a plurality of pocket-type containers attached to each of said overlapping cloth strips.

28. An apparatus as claimed in claim 25 wherein said support means automatically unwinds said cloth curtain due to the weight of the water applied to the cloth curtain from the water feed means flowing downward and collected in said water reservoir.

29. An apparatus as claimed in claim 25 wherein said water feed means is a metal tube adjacent said support means having a plurality of openings therein directed toward said cloth curtain.

30. An apparatus as claimed in claim 25 further comprising rope means fitted in the sides of said cloth curtain for giving structure to the sides of said curtain; and guide means fitted to the walls or support pillars for receiving said rope means and guiding therein the upward and downward movement of said cloth curtain attached to said rope means.

31. An apparatus as claimed in claim 30 wherein said guide means has a longitudinal groove therein along the length of said wall or support pillar for containing therein said rope means and the portion of said cloth curtain to which it is attached, whereby the upward and downward movement of said cloth curtain is guided along said groove.

* * * * *